US006131202A

United States Patent [19]

Yan

[11] Patent Number: 6,131,202

[45] Date of Patent: Oct. 17, 2000

[54] MULTI-AXIALLY STRETCHABLE FABRIC CAP

[76] Inventor: Suen Ching Yan, 17145 Margay Ave., Carson, Calif. 90746

[21] Appl. No.: 09/428,000

[22] Filed: Oct. 27, 1999

[51] Int. Cl.[7] ..... A42B 1/00

[52] U.S. Cl. ..... 2/195.3; 2/181; 2/183

[58] Field of Search ..... 2/195.2, 195.3, 2/181, 183, 195.1, 175.1, 417, 418

[56] References Cited

U.S. PATENT DOCUMENTS

| | | | |
|---|---|---|---|
| 1,958,345 | 5/1934 | Lazarus | 2/181 |
| 4,491,985 | 1/1985 | Dalton | 2/171 |
| 4,662,007 | 5/1987 | Lipkin | 2/195 |
| 4,856,116 | 8/1989 | Sullivan | 2/181 |
| 5,715,540 | 2/1998 | Cho | 2/195.3 |
| 5,862,522 | 1/1999 | Cho | 2/195.1 |
| 5,920,910 | 7/1999 | Calvo | 2/181.4 |
| 5,956,773 | 9/1999 | LaMantia | 2/195.1 |
| 6,049,911 | 4/2000 | Bromberg | 2/195.3 |

*Primary Examiner*—Bibhu Mohanty
*Attorney, Agent, or Firm*—Cislo & Thomas LLP

[57] ABSTRACT

A multi-axially stretchable fabric cap which utilizes a multi-axially stretchable fabric for a majority of the gores making up the cap, such that a more comfortable fitting cap is obtained and wherein the cap has an inner headband consisting of a foam synthetic material so as to alleviate pressure about the head of the wearer and wherein the cap is sewn with stretchable thread.

4 Claims, 2 Drawing Sheets

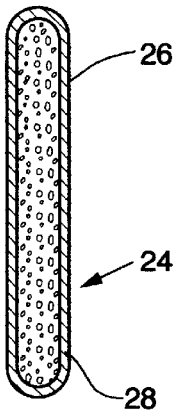
FIG. 5.
FIG. 3.
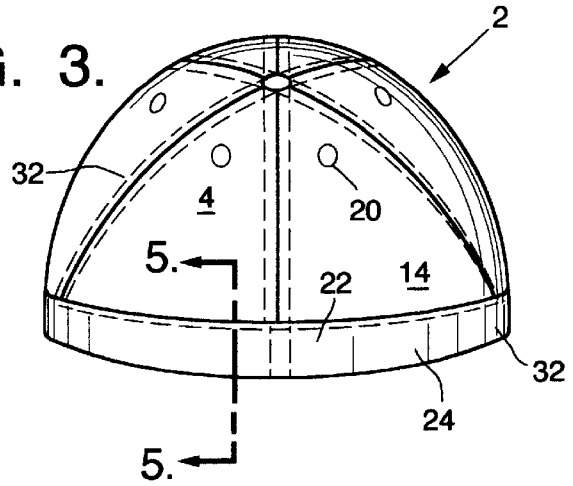
FIG. 4.
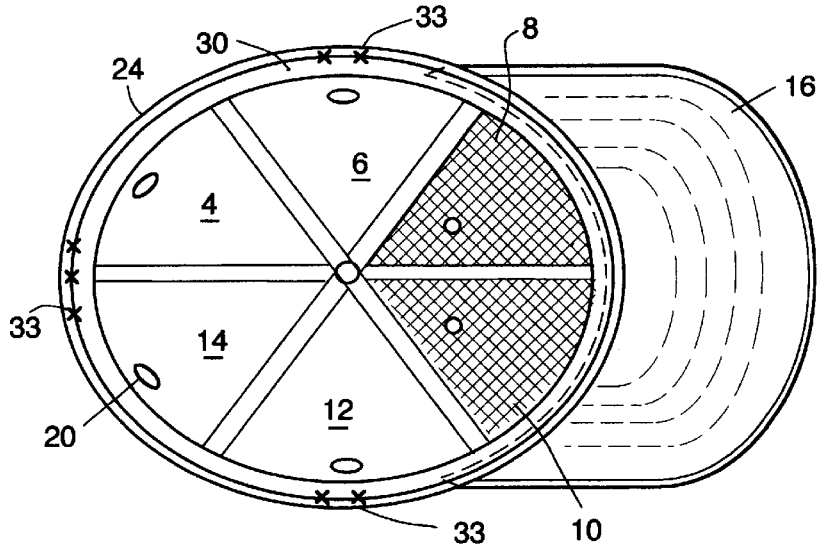
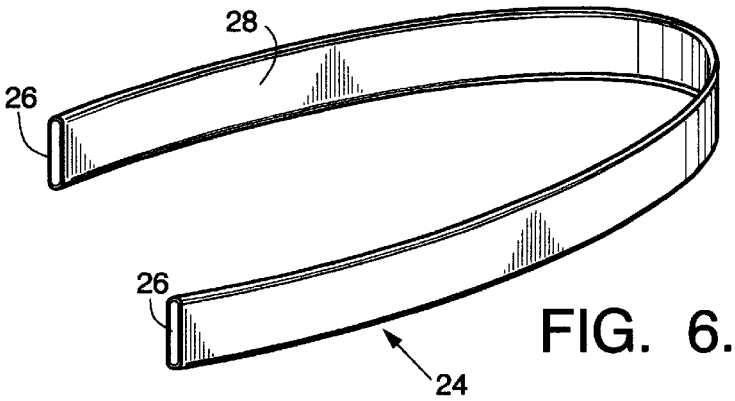
FIG. 6.

MULTI-AXIALLY STRETCHABLE FABRIC CAP

BACKGROUND OF THE INVENTION

Field of the Invention

This invention relates to a stretchable cap which is made of a fabric that, as opposed to being uni-axially stretchable in any direction, is multi-axially stretchable so that the cap construction fits the head of the wearer without undo pressure so as not to leave a mark or band around the head of the wearer.

It is generally known that there are a plurality of different types of caps that have been available for a number of years, some having various adjustable features in order to fit myriad head sizes. The attributes and detriments of such caps are generally known and probably the most ubiquitous cap is the type having a cutout or gap in the back with a band that is adjustable by reason of a plurality of slots which are engageable with one of a plurality of protuberances in order to adjust the headband size of the cap.

In most of the prior art caps, even including those which utilize what might be considered stretchable fabric, that is where the stretchable fabric is uni-axially stretchable, these caps and hats have not been altogether desirable from the aspect of being comfortably fitted to the head of the wearer.

That is, many of the prior art caps, because of their inability to give or stretch in a plurality or multiplicity of directions, causes undo pressure around the head of the wearer thereby leaving a mark or certainly providing discomfort during wearing of the cap.

One cap that has made great strides with respect to its ability to fit a variety of shaped heads is the cap disclosed in Cho U.S. Pat. No. 5,715,540. However, in this patent a free sized cap is disclosed which is fabricated of a fabric which is uni-axially stretchable and is of woven material capable of being stretched in only one direction. As indicated, such a cap suffers in that in order to be truly comfortable on the head of a wearer stretchability is desirable in both directions, that is vertically and horizontally, when considering the plane of a fabric. Further such caps are not made with a cushioned head or sweat band fabricated with stretchable thread so as to impart true comfort to the wearer of a cap so made.

SUMMARY OF THE INVENTION

The invention relates to a woven fabric cap made up of a plurality of gores wherein at least the majority of the gores making up the cap are of woven material which is axially stretchable in a plurality of directions so as to provide an easy fit for the head of the wearer.

Additionally the cap is provided with a lower peripheral edge which has attached to it, by means of multi-axially stretchable thread, a foam circumferential member which is overlain with the same stretchable fabric as making up the plurality of gores comprising the cap.

With a multi-axially fabric being utilized wherein the fabric is not uni-axially stretchable, the cloth which may be of cotton, for example, is woven with a stretchable synthetic fiber in both the warp and weft of the fabric so as to provide stretchability in more than one axial direction of the fabric making up the cap.

The lower peripheral edge of the cap is provided with a thin layer of foam material of synthetic origin and is adhered to the lower peripheral portion of the cap by means of stretchable thread to thereby provide an inherently stretchable, form fitting cap adapted to conform to the head of a myriad of wearers.

OBJECTS OF THE INVENTION

It is an object of the present invention to provide a comfortable cap of multi-axially stretchable fabric.

It is still another important object of the invention to provide a cap which is comfortable to wear and which does not leave an impression about the forehead of the wearer of the cap.

It is still another important object of the invention to provide a cap which is formed with multi-directional, stretchable, woven fabric having a thin, synthetic foam band which has an over cover of the same fabric making up the majority of the cap and wherein the band is adhered to the body of the cap by means of stretchable thread.

It is another still more important specific object of the invention to provide a cap which is easy to wear and which provides the attributes of being stretchable in a plurality of directions as opposed to being uni-axially stretchable and wherein the cap construction is such that the pressure about the forehead and contiguous areas of the head are not left with undo pressure points so as to make wearing the cap comfortable.

Generally speaking the cap of the invention is directed to a multi-axial stretch fabric cap having main body made up a plurality of gores forming a crown portion with a lower peripheral edge wherein at least some of said plurality of gores are composed of multi-axial stretchable fabric having a stretchable fiber woven in both the warp and weft of the fabric. A sweatband is operatively associated with the lower peripheral edge and consists of a thin layer of synthetic foam material having a fabric covering identical in structure and composition to the multi-axially stretchable fabric making up the remainder of the cap and wherein the headband is sewn to a lower peripheral edge of the cap with stretchable thread whereby an inherently stretchable form fitting cap, adapted to conform to head of the wearer, is obtained.

These and other objects and advantages of the present invention will become apparent from a review of the following specification and accompanying drawings.

BRIEF DESCRIPTION OF THE DRAWINGS

FIG. 3 is a back view of the cap shown in FIG. 1 with the inside peripheral edge portion being in the pulled down position to show more details of construction;

FIG. 4 is a bottom view of the cap shown in FIG. 1 but with the perimetric band in the secured position, as opposed to that shown FIG. 3;

FIG. 5 is an enlarged view taken along the line 5—5 of FIG. 3 showing more detailed construction of the head or sweatband; and FIG. 6 is an enlarged schematic view illustrating the construction of the head or sweatband utilized in the cap of the invention.

DESCRIPTION OF THE PREFERRED EMBODIMENTS

Figure 1:
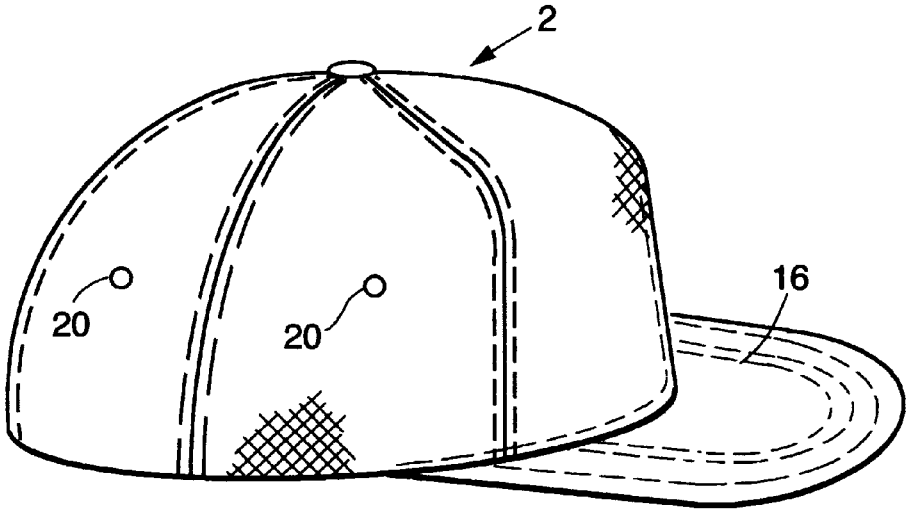
FIG. 1 is a perspective view of the cap of the invention.
Figure 2:
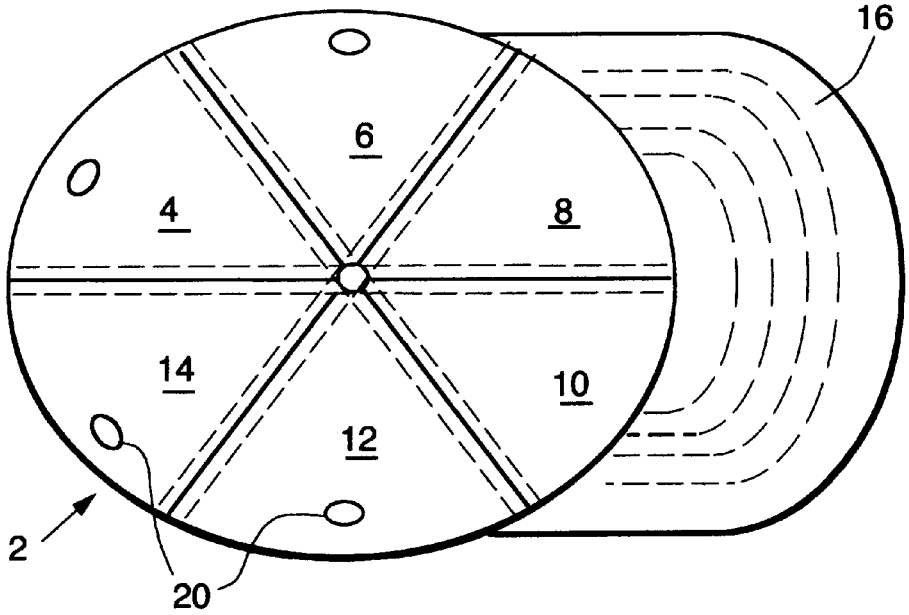
FIG. 2 is a top view of the cap shown in FIG. 1.

Referring to the drawing where like numerals of reference indicate like elements throughout it will be noted that the cap 2 is of the usual shape being made up of a plurality of gores

4, 6, 8, 10, 12 and 14 and having the usual bill or visor 16 in this particular instance being curved and having an underlying member (not shown) of curved plastic which is covered over with the material of which the cap 2 is fabricated, as will be more fully explained. In this particular instance, it is preferred so as to give some free standing ability to the cap 2, that the gores 10 and 8 be of stiff or non-stretchable fabric as compared to the gores 4, 6, 12 and 14 which are of a stretchable fabric as will be further delineated hereinafter.

The gores are sewn together as is usually the case and may, if desired, have air vents such as 20 for the ventilation purposes.

The cap 2 as indicated is fabricated with the gores being sewn together in usual fashion and has a depending peripherial edge 22 at the bottom of which is secured a head liner or sweatband 24 in this particular instance consisting of a thin foam comfortable material 26 which has overlaying it a fabric covering 28 preferably of the same color and material as that comprising the gores 4, 6, 12 and 14.

The sweatband or head liner 24 is of sufficient length to engage the entire internal periphery 30 of cap 2 and is attached to lower peripheral edge 22 by means of thread stitches 32 which thread, like the other stitches comprising cap 2, is composed of elastomeric or stretchable thread. The sweatband or head liner 24 is first attached as seen in FIG. 3, then folded upwardly inside the cap and tacked at plurality of places by thread tacks 33.

The specific materials of construction making up the unique cap of this invention whose main feature has the multi-axially stretchable woven fabric, which the exception of the front gores superpositioned, the bill or visor 16 and having the soft conformable foam liner going about the circumference of the head of the wearer so as to make the cap comfortable to wear and not leaving marks on the forehead, as other caps of prior art design can do, will be described hereinafter.

The Bill or Visor

The bill or visor 16, as indicated, is fashioned of molded plastic having a curvilinear design or a flat straight design if desired, and overlying the plastic component is fabric which is of the same color, preferably, and construction with respect to stretchability as the stretchable fabric of cap 2 with which the bill or visor is associated and the fabric covered visor is attached to the main body of the cap 2 below the two non-stretchable gores 8 and 10 by conventional means such as sewing. While not necessary it is desirable that all of the thread of construction be stretchable so as to impart the highest degree of stretchability in all direction of the cap 2, even for the visor 16.

The Fabric

The preferred fabric is of cotton and is woven with spandex which is a synthetic fiber composed of a long chain polymer which of course adds elasticity to the fabric. The preferred fabric has the following characteristics:

| Yarn Count (ASTM D1059-1987 (1992)) | |
|---|---|
| Warp (with elastomer) | 41.0 Tex (28.8's/2) |
| Weft (with elastomer) | 38.6 Tex (30.6's/2) |

-continued

| Fabric Weight Per Unit Area (ASTM D3776-1996; Option C) | |
|---|---|
| (oz/sq. yd) | 9.4 |
| (g/sq. m) | 317.7 |

| Threads Per Inch (ASTM) D3775-1996) | |
|---|---|
| Warp (ends) | 92 |
| Weft (picks) | 59 |

| Fibre Content (AATCC 20A-1995; based on moisture regain weight) | | |
|---|---|---|
| Warp Yarn: | Cotton | 94.5% |
| | Spandex | 5.5% |
| West Yarn: | Cotton | 95.6% |
| | Spandex | 4.4% |

| Based on Total Weight | |
|---|---|
| Cotton | 95.0 |
| Spandex | 5.0% |

Note:
Moisture regain of Cotton: 8.0% & Spandex: 1.3%

Foam Liner

The foam liner is of rather thin dimensions, it being preferably in a range of 4/32 to 5/32 inch thick and being comprised of a foam polymer having an open air cell porosity. The typical width of the foam liner will be about 1¼ to 1⅜ whereas the length of course will be equal to the perimeter of the lower portion of the cap itself. The foam liner is, as indicated, sewn within the fabric making up the cap and is sewn with the same type of thread as the remainder of the cap.

Thread

As indicated the thread used in fabricating the cap of the invention in its entirety is of the following characteristics:

The thread is a typical commercially available nylon elastic thread and is of appropriate thickness as those of ordinary skill in the art will recognize. The thread need only be strong enough to withstand the stretching forces to which the components making up the cap will be put. It is important, however that the thread itself be of sufficient elasticity so as to contribute to the overall conformability of the cap.

With the herein disclosed invention it will be noted that specific elements have been alluded to. These are for illustrative purposes only and there are various changes and modifications that will at once make themselves apparent to those with ordinary skill in the art and all such changes and modifications are intended to be covered by the appended claims.

What is claimed is:

1. A multi-axially stretchable fabric cap comprising:

a main body having a plurality of gores forming a crown portion having a lower peripheral edge wherein at least some of said plurality of gores are composed of multi-axially stretchable fabric having a stretchable synthetic fiber woven in both the warp and weft of said fabric, a sweat band operatively associated with said lower peripheral edge and consisting of a thin layer of synthetic foam material having a fabric covering identical in structure and composition to said multi-axially stretchable fabric, and being sewn to said lower peripheral edge with stretchable thread whereby an inherently stretchable form-fitting cap, adapted to conform to the head of the wearer, is obtained.

2. The cap in accordance with claim 1 wherein a visor of preformed plastic is operatively associated with the front of the cap and the two gores superpositioned of said visor are of non-stretchable material.

3. The cap in accordance with claim 2 wherein the remainder of the gores forming the crown portion of said cap are composed of woven material having spandex therewith so that stretchability in a plurality of directions is obtained.

4. The cap in accordance with claim 3 wherein said sweatband is tacked to the fabric making up said crown in a plurality of places.

* * * * *